United States Patent [19]

Lavery

[11] 4,027,631

[45] June 7, 1977

[54] COMBUSTION ENGINE DRIVEN LIQUID HEATER

[76] Inventor: Elzie E. Lavery, 424 S. Mount Vernon Ave., Uniontown, Pa. 15401

[22] Filed: July 6, 1976

[21] Appl. No.: 703,120

[52] U.S. Cl. ..... 122/26; 60/320; 122/7 R; 126/19.5; 126/247; 237/12.3 B

[51] Int. Cl.[2] ..... F22B 3/06; F28C 3/00

[58] Field of Search ..... 126/247, 19.5; 122/7 R, 122/26; 237/12.1, 12.3 B; 165/51; 60/320, 327; 62/238

[56] References Cited

UNITED STATES PATENTS

| | | | |
|---|---|---|---|
| 937,879 | 10/1909 | Smith | 126/19.5 |
| 1,598,289 | 8/1926 | Lee | 122/26 |
| 2,251,344 | 8/1941 | Tesch | 122/26 |
| 3,198,176 | 8/1965 | Helmer | 122/26 |

*Primary Examiner*—Ronald C. Capossela

*Attorney, Agent, or Firm*—Carothers and Carothers

[57] ABSTRACT

A combustion engine driven liquid heater wherein an internal combustion engine is utilized as the primary liquid heating energy source. The internal combustion engine is submerged in a container of liquid to be heated and is adapted to operate in its submerged condition. A friction heater is also submerged in the liquid to be heated and is driven from the internal combustion engine. In addition, the exhaust system of the internal combustion engine is caused to meander throughout the liquid before exhausting to the atmosphere. The liquid thus heated is then flowed through a heat dissipation or radiation system such as might be found in the conventional home. Thus, not only is the heat of combustion and all the heat produced by the power of combustion fully utilized to heat the liquid, but in addition, the heat given off due to friction of engine parts is also captured and fully utilized.

14 Claims, 1 Drawing Figure

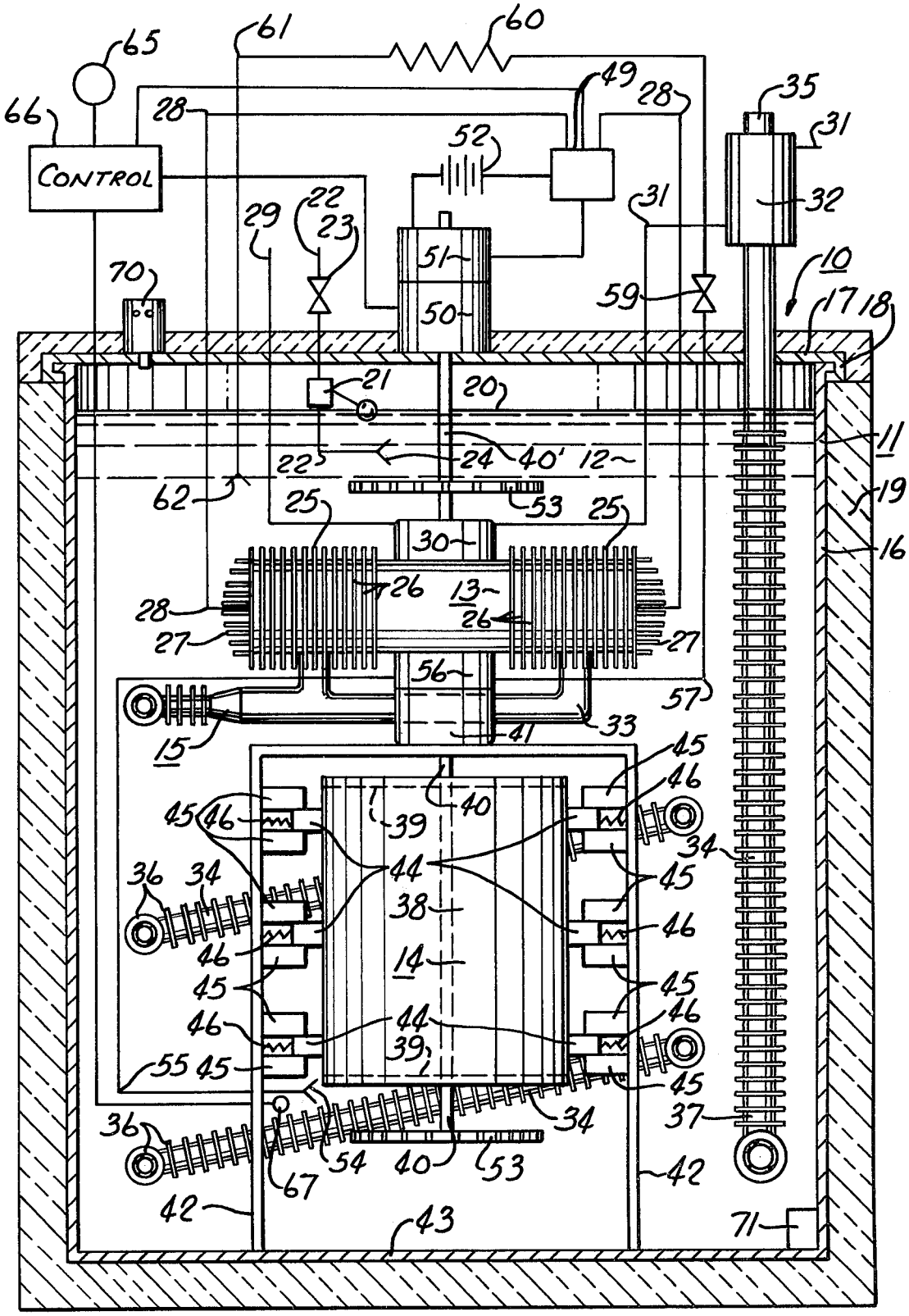
CONTROL
65
66
61
60
49
28
35
31
52
32
22
23
29
51
50
70
59
10
17
18
21
20
11
24
40'
12
62
53
19
25
30
16
26
13
27
56
57
15
41
33
45
46
40
39
44
34
36
38
14
55
37
54
67
42
43
71

COMBUSTION ENGINE DRIVEN LIQUID HEATER

BACKGROUND OF THE INVENTION

1. Field of Invention

This invention relates generally to furnaces and more particularly to furnaces driven by power plants in the form of internal combustion engines.

2. Discussion of the Prior Art

It is generally recognized in the furnace industry that most present day furnaces for heating building structures are much less efficient than desired and that a great deal of the heat energy produced by combustion type furnaces escapes unused up through the conventional vents, flues or chimneys. In addition, it is also recognized that those furnaces that do not rely upon combustion as an energy source (such as electric furnaces) are more expensive to operate under present day circumstances than those furnaces which utilize fluid or liquid fuels for combustion. It has thus become desirable to utilize gas or liquid fuel operated furnaces which are more efficient.

With regard to fuel combustion type furnaces, it further appears that those furnaces which heat a liquid for circulation such as water, are generally considered more efficient than those which do not heat a liquid for the heat transfer medium, such as direct forced air heating furnaces.

The conventional hot water furnace normally uses a combustion flame using natural gas, fuel oil or gasoline as the fuel to heat metal coils containing the water or liquid which is then circulated throughout the building for heat distribution. In this situation, it is obvious that the combustion fumes will eventually be vented to the atmosphere and that in doing so, much of the heat which might otherwise be utilized to heat the coils escapes through the chimney or exhaust system.

It has also been recognized that internal combustion engines which use a gas or liquid fuel may be utilized to heat liquids. However, these furnace or heating systems have been considered to be even less efficient than the conventional direct combustion liquid heaters or furnaces, as evidenced by the widely accepted use of the latter.

For example, U.S. Pat. No. 937,879 issued to E. B. Smith on Oct. 26, 1909, discloses utilization of the exhaust heat from an internal combustion engine to in turn heat a liquid for circulation throughout a building structure to dissipate the heat therein. The structure of Smith, however, makes utilization only of the exhaust heat, and it is obvious that a great deal of additional energy given off by the internal combustion engine is wasted, such as the heat created by the friction of the engine parts and the mechanical energy otherwise created by the engine. Improvements in recovering more of this useful energy have been made over the years.

For example, U.S. Pat. No. 2,256,303 issued to R. D. Williams on Sept. 16, 1941, discloses a heating system utilizing an internal combustion engine where air is flowed over the entire body of the engine in order to capture some of the heat dissipated from the engine body, and the mechanical energy given off from the engine is also further utilized to pump the heated air through the heating system.

U.S. Pat. No. 2,748,570 issued to J. H. Booth on June 5, 1956 also discloses the use of a combustion engine driven heater for heating liquids, wherein the heat of the internal combustion engine coolant is not only captured, but in addition he also attempts to capture as much of the heat as possible which is given off from the engine body or housing by using the hot air surrounding the engine body. However, this structure does not make full utilization of the mechanical energy given off from the engine for heating the fluid.

Other inventors have taken a different approach to heating liquids by the use of friction heaters. For example, see U.S. Pat. No. 1,819,057 issued to G. F. Archer on Aug. 18, 1931 and U.S. Pat. No. 1,919,681 issued to J. W. Anderson on July 25, 1933. Both of these liquid heaters utilize mechanical friction devices to heat a surrounding liquid. However, here again full efficiency of both apparatus are not realized, as considerable energy is required to move these frictional parts relative to each other and the heat given off by this prime mover is not captured for further utilization in heating the liquid.

It is the principal object of the present invention to eliminate or at least minimize the foregoing disadvantages of the prior art liquid heating devices and to provide a liquid heater which is more efficient and economical in operation.

It is a further object of the present invention to provide a liquid heater which does not require use of valuable space within a building structure as is required by most conventional heaters of present day use.

SUMMARY OF THE INVENTION

The liquid heater of the present invention is an internal combustion engine driven liquid heater which comprises a tank or container containing a liquid to be heated and wherein an internal combustion engine is suspended in the tank and submerged in the liquid and further adapted to operate or run in its submerged condition. A friction heater is also submerged in the liquid and is driven from the same internal combustion engine either directly or through a gear reduction. An exhaust pipe heat transfer device is connected to the engine to exhaust the combustion fumes therefrom. This exhaust pipe heat transfer device is caused to meander throughout the liquid before it is permitted to exhaust to the atmosphere in order to transfer as much exhaust heat as possible to the liquid. The liquid thus heated is then flowed through a heat dissipation system within the building structure to be heated.

In this manner, not only is all of the heat of combustion utilized, but in addition the heat produced by the power of combustion and the friction of engine parts during operation are also captured in the liquid surrounding the entire structure as the liquid operates as the medium of heat transfer and engine coolant.

When the exhaust is finally emitted to the ambient atmosphere, any additional heat remaining in these exhaust fumes may further be utilized to preheat the air intake into the internal combustion engine to create even greater combustion efficiency.

The heated liquid which is circulated throughout the building structure for heat dissipation is recirculated to the liquid containing tank to be reheated for maximum efficiency. In addition, means to automatically replenish fresh liquid to the tank is also provided in order to maintain the liquid level within the tank at a predetermined level.

The tank is also preferably sealed or covered with a top, and the entire unit may be covered with insulation for maximum efficiency. This also permits the unit to be stored outside the building structure thereby permitting savings of needed building space within the building structure. When a cover is provided on the tank to seal the same, a pressure safety relief valve is provided to prevent excessive buildup of pressure within the tank. In addition, conventional temperature limit safety devices may also be provided within the system to stop operation of the internal combustion engine should temperatures reach a dangerous level.

The friction heater unit provided within the tank of liquid generally consists of one or more stationary friction pads which bear against rotating elements driven from the internal combustion engine. The heat thus given off by the friction created between the rotor and pads is thus dissipated to the liquid medium.

It is preferable that the internal combustion engine and that the friction heating unit be connected together as one unit so that the entire assembly may be readily removed from the tank for repair or maintenance.

In addition, a clutch may be provided between the output of the engine and the friction heater unit so that the friction heating unit may be disengaged during initial startup of the engine. This clutch may, for example, be of the centrifugal type which will engage at a predetermined operation speed of the internal combustion engine.

In order to flow the heated liquid throughout the building structure to be heated, a conventional pump may be utilized. In addition, the pump may be directly driven from the same internal combustion engine and the pump may further be submerged in the liquid to capture heat given off by its friction engaging parts.

The internal combustion engine utilized in the heating system of the present invention may operate on any conventional fuel such as natural gas, gasoline, fuel oil, etc. However, a deisel internal combustion engine is preferred due to its economical operation, and further in view of the fact that it is more readily adaptable to operation in a submerged condition.

Safety devices may also be provided to either give off a danger signal or shut down operation of the system automatically when the supply of lubrication to the moving parts of the internal combustion engine is dangerously low. This, of course, is only required with those systems which require a separate lubrication supply. In addition, a conventional detection system may also be provided for the fuel supply to the internal combustion engine to indicate to the proper personnel that the fuel needs to be replenished.

BRIEF DESCRIPTION OF THE DRAWINGS

Other objects and advantages appear in the following description and claims.

The accompanying drawing shows, for the purpose of exemplification without limiting the invention or the claims thereto, certain practical embodiments illustrating the principles of this invention.

The drawing is a diagrammatic view in partial section in elevation of one embodiment of the internal combustion engine driven liquid heater of the present invention.

DETAILED DESCRIPTION OF THE INVENTION

Referring to the drawing, the combustion engine driven liquid heater 10 comprises a tank 11 containing a liquid 12 therein to be heated, an internal combustion engine 13 which is submerged in the liquid 12 and adapted to operate in its submerged condition, a friction heater 14 which is also submerged in the liquid 12 and driven from internal combustion engine 13, and exhaust pipe heat transfer means 15 which meanders through the liquid 12 to further heat the same.

The tank 11 is in the form of a metal or plastic drum 16, which may, for example, be a used 55 gallon oil drum. Tank 11 is also provided with a lid 17 which seals the top of drum 16 as indicated at 18. This may be an annular snap fit between the lid 17 and the drum 16 as indicated at 18, or any other conventional clamps or seals may be employed. This seal permits pressure buildup within the tank 11 to a safe limited degree in order to assist in heating the liquid 12. The entire tank 11, including lid 17, is covered with insulation 19 in order to minimize heat loss. Such insulation also permits this entire heating unit to be stored outdoors so that valuable indoor space is saved for other purposes.

The liquid 12 generally consists of a mixture of water and anti-freeze. However, it is obvious that other liquids may be employed where desirable.

The liquid level 20 is maintained in the tank by means of a float valve indicated diagrammatically at 21. Fresh liquid is continually supplied from a source through pipe 22 and valve 23 to outlet 24.

Internal combustion engine 13 may be of any conventional type, but it must be adapted to operate in its submerged condition. In other words, all electrical connections must be insulated and the engine must be otherwise sealed to prevent seepage of the liquid into the working parts of the engine. The internal combustion engine 13 is in this instance illustrated as a two-cylinder deisel engine. The two cylinders are indicated at 25 and they are provided with a plurality of cooling fins 26. Each cylinder 25 is provided with a cylinder head 27 which is also provided with cooling fins to assist in dissipating the heat given off from the engine to the surrounding liquid 12.

The engine 13 should be provided with a reserve lubrication reservoir tank (not shown) to make certain lubrication will always be supplied to the engine. This reserve tank should also be equipped with a shut-down or signaling device when the lubricant level becomes dangerously low.

Each head 27 is provided with an insulated electrical connection 28 which connects an electrical source to the respective spark plugs or glow plugs within each cylinder for ignition.

Fuel oil is supplied from a reservoir through line 29 to carburetor 30 of engine 13. Air is also supplied to the carburetor 30 through line 31 which passes through exhaust muffler jacket 32 for preheating.

Engine 13 is provided with the exhaust system 15 in order to exhaust the combustion gases and to further heat the liquid 12. The exhaust system 15 consists generally of the thicker and larger header pipe 33 which is connected to each cylinder, and a smaller exhaust pipe 34 which meanders through the liquid 12 to be heated and finally exhausts to the atmosphere at 35.

The exhaust header 33 is made much thicker and heavier than the remaining exhaust pipe 34 in order to prevent carbon buildup and also to prevent excessive heat dissipation and boiling of the liquid at this point in the exhaust system.

The smaller exhaust pipe 34 is provided with a large number of circular heat dissipation fins 36 in order to assist in dissipating the heat given off by exhaust pipe 37 from exhaust gases to the liquid 12.

As shown in the FIGURE, the exhaust pipe 34 spirals in a counterclockwise manner as viewed from the top of the apparatus, downwardly until it nearly reaches the bottom at which point it then reverses its direction and rises upwardly as indicated at 37 to pass through the lids 17 and exhaust into the ambient atmosphere after passing through muffler 32. Muffler 32 is provided for noise suppression and also has an outer jacket which serves as a preheater for the air intake of internal combustion engine 13 thereby conserving additional heat energy. The muffler 32 may, of course, also be submerged within the liquid 12.

The friction heater 14 consists of a friction drum 38 which is secured by spokes 39 to drive shaft 40 for rotation therewith. Drive shaft 40 is rotatably driven by engine 13 through a gear reduction 41. Gear reduction 41 is preferably 10:1.

Engine 13 as well as the friction heater 14 are supported from frame 42 which rests on the bottom 43 of tank 11. Support 42 is bolted to the housing of gear reduction 41 such that the entire internal assembly together with lid 17 may be removed from drum 16 as one unit.

Friction heater 14 further consists of a plurality of friction pads 44 which are slidably engaged in guides 45 and biased by compression springs 46 so that the pads 44 are in continual frictional engagement with friction drum 38. This friction creates additional heat from the mechanical energy given off by engine 13 to heat the liquid 12.

Drive shaft 40 also extends out the opposite side of internal combustion engine 13 in the form of shaft 40′ which is engaged with starter motor 50 and generator 51. Starter motor 50 is, of course, utilized to initially start engine 13 through a clutch mechanism (not shown) such as a centrifugal clutch and shaft 40′. The clutch assembly is also housed within starter housing assembly 50.

Generator 51 is utilized to recharge the starter battery 52 and the entire electrical system is regulated by voltage regulator and ignition control 49 in the conventional manner.

Vane-type circulators 53 are connected to drive shafts 40 and 40′ at the bottom and top of the apparatus as indicated and rotate with the drive shaft to assist in circulating the liquid throughout the container or tank 11 to more uniformly heat the same.

The hotter liquid 12 will generally be found at the bottom of drum 16 and therefore liquid inlet 54 is provided adjacent the bottom of the tank and the heated liquid is drawn through conduit 55 by means of pump 56. The pumped liquid is pumped out through conduit 57, valve 58, and then through a heat dissipation system such as a radiator as diagrammatically illustrated at 60 and then returned through conduit 61 to outlet 62 within the tank to recirculate the liquid for reheating. Heat dissipation system 60 would normally be within the interior of a building structure to be heated.

The entire heating system is regulated with a conventional thermostat control system. A thermostat 65 is provided within the structure to be heated, and upon the prescribed minimum temperature being obtained, the thermostat will cause control 66 to come into operation to start engine 13 through starter 50. The control also operates to stop engine 13 when a predetermined maximum temperature is obtained within the structure to be heated.

A conventional thermostat 67 is also provided inside of tank 11 as a safety feature to shut down the apparatus should the liquid 12 become overheated or the engine 13 become overheated.

Different structure may be provided for the friction heater 14. For example, the drum may be replaced with friction discs and friction pads may be used which are simpler in function to that of the friction pads used in the brake system of an automobile, except in this instance, braking pressure is continuously supplied.

Also, gear reduction 41 includes a centrifugal clutch so that engine 13, when being started, may work up to operational speed before engaging the frictional load of friction heater 14.

A conventional pressure relief valve 70 is provided in the top 17 of the tank 11 and exhausts the vapors within the tank 11 to the ambient atmosphere in the event that pressures within the vessel become dangerously high.

A magnet 71 is also provided in the bottom of drum 16 in order to assist in collecting unwanted residue such as metal fragments or other magnetically-attracted material in order to minimize the clogging of the system.

I claim:

1. An internal combustion engine driven liquid heater comprising a tank containing a liquid to be heated, an internal combustion engine suspended in said tank and submerged in said liquid and adapted to operate in its submerged condition, friction heater means submerged in said liquid and driven from said internal combustion engine, exhaust pipe heat transfer means connected to said engine to exhaust combustion fumes therefrom, said exhaust pipe heat transfer means meandering through said liquid before exhausting to the atmosphere to transfer exhaust heat to said liquid, and means to flow said liquid through a heat dissipation system.

2. The combustion engine driven liquid heater of claim 1 including means to recirculate said liquid flowed through the heat dissipation system back to said tank.

3. The combustion engine driven liquid heater of claim 1 including means to replenish fresh liquid to said tank to a predetermined level.

4. The combustion engine driven liquid heater of claim 1 including a cover temporarily secured over said tank and insulation means covering said tank.

5. The combustion engine driven liquid heater of claim 1 wherein said friction heater means consists of stationary friction pads bearing against rotary means driven from said engine.

6. The combustion engine driven liquid heater of claim 1 including control means to start and stop said engine and said means to flow said liquid upon command from a thermostat signal at predetermined temperature levels.

7. The combustion engine driven liquid heater of claim 1 wherein said engine and said friction heater means are connected together as a unit, said unit being removable from said tank.

8. The combustion engine driven liquid heater of claim 1 including clutch means between said engine and said friction heater means to disengage the latter from said engine during starting operation of said engine.

9. The combustion engine driven liquid heater of claim 8, wherein said clutch means is a centrifugal clutch engageable at a preselected operation speed of said engine.

10. The combustion engine driven liquid heater of claim 1 wherein said means to flow said liquid includes a pump.

11. The combustion engine driven liquid heater of claim 10 wherein said pump is driven from said engine.

12. The combustion engine driven liquid heater of claim 1 wherein said engine is a deisel internal combustion engine.

13. The combustion engine driven liquid heater of claim 1 including a cover sealing said tank, and a pressure relief valve in said cover to exhaust gases and vapors in said covered tank upon attaining a predetermined danger pressure.

14. The combustion engine driven liquid heater of claim 1 including a thermostat positioned to sense the temperature of said liquid and operable to stop said engine when said liquid attains a predetermined level.

* * * * *